US007941077B2

(12) United States Patent
Oshima et al.

(10) Patent No.: US 7,941,077 B2
(45) Date of Patent: May 10, 2011

(54) CONDUCTIVE MEMBER, PROCESS CARTRIDGE USING CONDUCTIVE MEMBER, AND IMAGE FORMING APPARATUS USING PROCESS CARTRIDGE

(75) Inventors: Tadayuki Oshima, Atsugi (JP); Hiroki Furubayashi, Atsugi (JP); Taisuke Tokuwaki, Sagamihara (JP); Yutaka Narita, Sagamihara (JP); Makoto Nakamura, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 503 days.

(21) Appl. No.: 12/044,521

(22) Filed: Mar. 7, 2008

(65) Prior Publication Data

US 2008/0219703 A1 Sep. 11, 2008

(30) Foreign Application Priority Data

Mar. 8, 2007 (JP) ..... 2007-058793

(51) Int. Cl.
*G03G 15/02* (2006.01)

(52) U.S. Cl. ..... 399/168; 399/174; 399/176

(58) Field of Classification Search ..... 399/168, 399/174, 176

See application file for complete search history.

(56) References Cited

U.S. PATENT DOCUMENTS

| | | | | |
|---|---|---|---|---|
| 2004/0096247 | A1* | 5/2004 | Ki et al. | 399/286 |
| 2006/0188293 | A1 | 8/2006 | Narita et al. | |
| 2006/0270541 | A1 | 11/2006 | Narita et al. | |
| 2007/0116493 | A1* | 5/2007 | Nakamura et al. | 399/176 |
| 2007/0166076 | A1 | 7/2007 | Oshima et al. | |
| 2008/0038016 | A1 | 2/2008 | Tokuwaki et al. | |
| 2008/0044751 | A1 | 2/2008 | Nakamura et al. | |
| 2009/0142099 | A1* | 6/2009 | Oshima | 399/176 |
| 2009/0180806 | A1 | 7/2009 | Oshima et al. | |

FOREIGN PATENT DOCUMENTS

| | | |
|---|---|---|
| JP | 63-149668 | 6/1988 |
| JP | 1-211779 | 8/1989 |
| JP | 1-267667 | 10/1989 |
| JP | 3-240076 | 10/1991 |
| JP | 2002-132019 | 5/2002 |
| JP | 2002-311687 | 10/2002 |
| JP | 2005-91818 | 4/2005 |
| JP | 2005-121982 | 5/2005 |
| JP | 2005-275412 | 10/2005 |
| JP | 2006-85006 | 3/2006 |

* cited by examiner

*Primary Examiner* — Ryan D Walsh
(74) *Attorney, Agent, or Firm* — Oblon, Spivak, McClelland, Maier & Neustadt, L.L.P.

(57) ABSTRACT

A conductive member includes a conductive supporter, an electric resistance adjusting layer formed on the conductive supporter and gap retaining members which are of a different material from that of the electric resistance adjusting layer and are disposed respectively at both ends of the electric resistance adjusting layer for contacting an image carrier so as to maintain a predetermined gap between the electric resistance adjusting layer and the image carrier, wherein the electric resistance adjusting layer is made from a resin composition containing a thermoplastic resin containing an ether group, an organic phosphonium salt and a fluorine-containing organic anion salt.

15 Claims, 2 Drawing Sheets

CONDUCTIVE MEMBER, PROCESS CARTRIDGE USING CONDUCTIVE MEMBER, AND IMAGE FORMING APPARATUS USING PROCESS CARTRIDGE

CROSS-REFERENCE TO THE RELATED APPLICATION

The present application is based on and claims priority from Japanese Application Number 2007-58793, filed on Mar. 8, 2007, the disclosure of which is incorporated by reference herein in its entirety.

BACKGROUND OF THE INVENTION

1. Field of the Invention

The present invention relates to an electrical conductive member, a charging member using the electrical conductive member, a process cartridge using the charging member, and an image forming apparatus using the process cartridge.

2. Description of the Related Art

An electrophotographic image forming apparatus such as a copying machine, a laser beam printer, or a facsimile has been conventionally provided with a charging member that performs an electrification process on a photoreceptor drum (an image carrier), and a transfer member that performs a transfer process on a toner on the photoreceptor drum. An electrical conductive member is used as the charging member or the transfer member.

FIG. 1 illustrates a schematic structure of an image forming apparatus. The image forming apparatus 1 is composed of a photoreceptor drum 4 serving as an image carrier where an electrostatic latent image is formed; a charger roller 2 serving as a charging member that performs an electrification process on the photoreceptor drum 4; a developing roller 6 that causes a toner 5 to adhere to the electrostatic latent image on the photoreceptor drum 4; a transfer roller 7 that transfers a toner image on the photoreceptor drum 4 to a recording paper S; and a cleaning blade 8 for cleaning the photoreceptor drum 4 after the transfer process. Reference numeral 9 denotes waste toner discharged by a cleaning member for removing residual toner on the photoreceptor; 10, a developing unit; and 11, a cleaning unit. Incidentally, functional units generally required for other electrophotographic processes are omitted from FIG. 1 as their explanation is unnecessary.

The charger roller 2 is powered by a power pack (not shown) to electrify the photoreceptor drum 4 to a desired potential. This photoreceptor drum 4 is rotated in the direction of arrow A by a drive unit (not shown). A surface electrometer (not shown) is installed just behind the charger roller 2 along the direction of the rotation of the photoreceptor drum 4 to measure a potential of a surface 4*a* of the photoreceptor drum 4.

The developing roller 6 attaches the toner to the electrified photoreceptor drum 4. The transfer roller 7 transfers the toner image on the photoreceptor 4 to the recording paper S. The cleaning blade 8 removes the residual toner on the photoreceptor drum 4 to clean the photoreceptor drum 4.

An image forming process of the image forming apparatus 1 is as follows. First, the surface 4*a* of the photoreceptor drum 4 is electrified to a negative high potential by the charger roller 2. Then, the surface 4*a* is exposed. Corresponding to an amount of light received by this exposure L, a potential distribution is formed on the surface 4*a*, and, as a result, an electrostatic latent image is formed on the surface 4*a*.

When the photoreceptor drum 4 is rotated and a part where an electrostatic latent image on the surface 4*a* was formed passes the developing roller 6, the toner corresponding to the potential distribution adheres to the surface 4*a*. As a result, an electrostatic latent image is made visible as the toner image. This toner image is transcribed on a fed recording paper S by the transfer roller 7 with a prescribed timing, and the recording paper S is conveyed in the direction of arrow B toward a fixing unit (not shown).

Meanwhile, after the transcribing, the cleaning blade 8 is used to remove the residual toner from the photoreceptor drum 4 and clean the photoreceptor drum 4, accompanied by a quenching lamp (not shown) for removing the charge before shifting to the following image forming process.

A conventional electrification method employed in the image forming apparatus 1 is commonly known as a contact-type electrification method where the charger roller 2 is in contact with the photoreceptor drum 4. (for reference, see Japanese Application Publication Numbers S63-149668, Hei 1-211779 and Hei1-267667)

However, the conventional contact-type electrification method using the charger roller 2 has the following problems (1) to (5).

(1) The charger roller leaves traces thereof on the surface of the photoreceptor drum because a constituent substance of the charger roller exudes from the charger roller and adheres onto the surface of the photoreceptor drum.

(2) Static crackling is emitted because the charger roller 2 in contact with the photoreceptor drum vibrates when subjected to an alternating voltage.

(3) The charger roller undergoes a deterioration in electrification performance because the toner on the photoreceptor drum adheres to the charger roller (or, in particular, the above-mentioned exudation increases the likelihood of adhesion of the toner).

(4) The constituent substance of the charger roller is prone to adhere to the photoreceptor drum.

(5) The charger roller undergoes permanent deformation when the photoreceptor drum is not in use for a long time.

As a method for solving the above problems, instead of bringing the charger roller 2 into contact with the photoreceptor drum 4, there is proposed a proximity electrification method which involves bringing the charger roller 2 into proximity with the photoreceptor drum 4 (as disclosed in Japanese Application Publication Number Hei3-240076). The method is used to electrify the photoreceptor drum by applying a voltage to the charger roller 2 disposed facing the photoreceptor drum with a distance (a gap will be used hereinafter) of 50 μm to 300 μm in between when the charger roller and the photoreceptor drum are in closest proximity to each other.

Because no contact is provided between the charger roller 2 and the photoreceptor drum 4, the proximity electrification method does not present the problems inherent in the conventional contact-type electrification method, namely, "the adhesion of the constituent substance of the charger roller to the photoreceptor drum" and "the permanent deformation of the charger roller caused by the photoreceptor drum being out of use for a long time." As for "the deterioration in the electrification performance of the charger roller due to the adhesion of toners," the proximity electrification method is superior because a lesser amount of the toner is adhered to the charger roller.

The required characteristic properties of the charger roller for the proximity electrification method are different from those of the charger roller for the contact-type electrification method. The periphery of a core of the charger roller generally used for the contact-type electrification method is covered by an elastic member made of a vulcanized rubber, etc.

The charger roller is required to come in contact with the photoreceptor uniformly so as to uniformly electrify the photoreceptor when the contact-type electrification method is used.

In contrast, when the proximity electrification method is used instead of the contact-type electrification method, if the charger roller is made of the elastic member, problems may arise as follows.

(1) So as to generate the gap between the photoreceptor and the charger roller, it is required that a gap retaining member be disposed in close proximity to the photoreceptor, such as a spacer, in a non-image area at both ends of the charger roller. However, when the charger roller is made of the elastic member, due to a deformation of the elastic member, it is difficult to maintain a uniform gap width. Consequently, a fluctuation may be generated in an electrification potential or an irregular image may be caused by the fluctuation in the electrification potential.

(2) The elastic member made of the vulcanized rubber is prone to deform and decrease in quantity thereof with the lapse of time, which causes fluctuation in the width of the gap with the lapse of time.

In order to solve the above problems, it is proposed that a thermoplastic resin which is inelastic be used, which can maintain the gap width as constant. It is known that an electrification mechanism which charges the surface of the photoreceptor drum by the charger roller follows Paschen's law within a small space between the charger roller and the photoreceptor drum. It is necessary to control an electric resistance value of the thermoplastic resin within a semi-conductive range (about $10^6$ Ωcm~$10^9$ Ωcm) to make the photoreceptor drum function to maintain a prescribed electrification potential.

A known method for controlling the electric resistance value of the thermoplastic resin involves dispersing conductive pigments such as carbon black, etc. therein. However, when attempting to control the electric resistance value of the electric resistance adjusting layer within the semi-conductive range, because the electric resistance value fluctuates greatly, there occurs either a partial electrification deterioration or a local discharge (a leakage discharge) caused by an electron conduction. Consequently, a defective image is generated.

Another method to control the electric resistance value of the electric resistance adjusting layer is to add an ionic conductive material.

Since the ionic conductive material may be dispersed at the molecular level in a matrix resin, a fluctuation in the electric resistance value thereof is less than that when the conductive pigments are dispersed. Therefore, a resultant partial faulty electrification will not impair the image quality. However, the ionic conductive material having a low molecular weight such as an electrolyte salt is prone to bleed out to a surface of the matrix resin. When the electrolyte salt bleeds out to the surface of the charger roller, the adhesion of the toner will occur, which causes a defective image.

For the prevention of this bleed-out phenomenon, a polymeric ionic conductive material is proposed. Since the polymeric ionic conductive material is dispersed and immobilized at the molecular level in a matrix resin, the occurrence of the bleed-out to the surface of the matrix resin becomes infrequent. Although a polyamide-based elastomer, etc. is used as the polymeric ionic conductive material, since the electric resistance value of the electric resistance adjusting layer, made from such a material, is high, which makes it impossible to control the electric resistance value within the semi-conductive range only by using a polymeric ionic conductive material, the electrolyte salt is added so as to impart electrical conductivity.

Examples of the above-mentioned electrolyte salt include perchlorate such as a sodium perchlorate, a lithium perchlorate, etc. However, when the sodium perchlorate is used, because of a reaction thereof with moisture in the air on an ionic dissociation, a strongly-alkaline sodium hydroxide is generated. Consequently, the matrix resin is deteriorated with the lapse of time and (solvent) cracks are generated.

In order to prevent the cracks, the use of other electrolyte salts which do not generate a strongly-alkaline substance can be considered. To be specific, it is known that organic phosphonium salt can be added without the generation of the strongly-alkaline substance, which does not pose a problem in terms of the deterioration of the resin with the lapse of time and the generation of the cracks.

Concerning the conductive member, relevant technologies have been disclosed in Japanese Application Publication Number 2006-85006, Japanese Application Publication Number 2002-311687, Japanese Application Publication Number 2005-275412, Japanese Application Publication Number 2005-121982, Japanese Application Publication Number 2002-132019 and Japanese Application Publication Number 2005-91818.

As disclosed in Japanese Application Publication Number 2006-85006, a conductive rubber roller has a rubber layer formed around a conductive core material. The rubber layer is made of a foam containing 75 to 99.5 pts.wt. of acrylonitrile-butadiene rubber which contains 15 to 43 pts.wt. of nitrile, a 25 to 0.5 pts.wt. of polyethylene oxide-polypropylene oxide-acrylglycidyl ether ternary copolymer and 0.1 to 4.0 pts.wt. either of halogen-containing quaternary ammonium salts or of quaternary phosphonium salts.

As disclosed in Japanese Application Publication Number 2002-311687, an electrification roller is formed by applying an ionic conductive tube on an elastic layer. The ionic conductive tube is made from a polymer composition containing (A) a polymer selected from the group consisting of polyurethane, polyamide and polyester thermoplastic elastomers and (B) a quaternary phosphonium salt having at least three phenyl groups coupled to phosphorus atoms in a molecule thereof.

A conductive member, as disclosed in Japanese Application Publication Number 2005-275412, is obtained by molding a composition comprising a non-ether-based polyurethane, carbon black and bis (trifluoromethane sulfonyl) imide lithium.

As disclosed in Japanese Application Publication Number 2005-121982, a polyurethane foam is made by foam-curing the polyurethane foaming composition, which is a mixture of organic polyisocyanate, polyol, catalyst, foaming agent, and conductive material with inert gas, after mechanically stirring them. The conductive material contains an ionic conductive agent containing either potassium bis (trifluoromethane sulfonyl) imide or lithium bis (trifluoromethane sulfonyl)imido, or both. The Asker stiffness of the conductive roll is C5°-C80°, the resistance is $1\times10^4$~$1\times10^8$ Ω, and the mass density of the polyurethane foam is 0.1~0.8 g/cm$^3$.

In Japanese Application Publication Number 2002-132019, there is disclosed a charging member for a proximity electrification method. The charging member has an electric resistance adjusting layer consisting of a thermoplastic resin composition wherein polyetheresteramide components are dispersed as a polymeric ionic conductive material.

As disclosed in Japanese Application Publication Number 2005-91818, in a conductive rubber roller, a rubber layer is formed on a conductive core material. The conductive member is provided with a conductive supporter, an electric resistance adjusting layer installed on the peripheral surface thereof and a pair of gap retaining members firmly fixed to end surfaces of the electric resistance adjusting layer. A height difference is given between outer peripheral surfaces of the gap retaining members and the outer peripheral surface of the electric resistance adjusting layer so that a gap with a fixed width may be formed between the outer peripheral surface of the photoreceptor and that of the electric resistance adjusting layer when the conductive supporter is brought into contact with the photoreceptor, and outer peripheral surfaces of end parts of gap retaining members adjacent to the electric resistance adjusting layer are machined so as not to abut on the outside surface of the photoreceptor.

However, when the organic phosphonium salt is added alone, since a voltage dependency of the resistance value of the electric resistance adjusting layer is small, the resistance value rises when a high voltage is applied to a commercially-produced apparatus. Therefore, it is known that there are generated an irregular discharge and a defective image under the circumstances of low temperature and low humidity.

Therefore, via the addition of a fluorine-containing organic anion salt to the organic phosphonium salt, an absolute value of the resistance of the electric resistance adjusting layer is further lowered. It is known that even if the voltage dependency of the resistance value of the electric resistance adjusting layer is small, the irregular discharge would not occur under the circumstances of low temperature and low humidity.

Meanwhile, when a perchlorate is used to form the electric resistance adjusting layer, since a voltage dependency of a resistance value of the electric resistance adjusting layer is large, the resistance value rises remarkably due to a polarization of an electrolytic salt resulting from an energization over a long term. Therefore, it is known that an irregular discharge may occur after long-term use of the electric resistance adjusting layer.

In particular, it is known that when the charger roller is used by applying thereto a high voltage continuously, the resistance value of the electric resistance adjusting layer varies dramatically after long-term use compared with a resistance value thereof at an early stage.

In contrast, when the organic phosphonium salt and the fluorine-containing organic anion salt are used to form the electric resistance adjusting layer, since the voltage dependency of the resistance value of the electric resistance adjusting layer is small, the resistance value rises insignificantly due to the energization. Therefore, it is known that the irregular discharge does not occur even after long-term use of the electric resistance adjusting layer.

In view of the above problems, an object of the present invention is to provide an excellent electrical conductive member which is capable of maintaining a stable resistance value even after long-term use thereof without the generation of a defective image due to the irregular discharge, a process cartridge using the electrical conductive member, and an image forming apparatus using the process cartridge.

SUMMARY OF THE INVENTION

In order to achieve the above object, a conductive member according to one embodiment of the present invention includes a conductive supporter, an electric resistance adjusting layer formed on the conductive supporter and gap retaining members which are of a different material from that of the electric resistance adjusting layer and are disposed respectively at both ends of the electric resistance adjusting layer for contacting an image carrier so as to maintain a predetermined gap between the electric resistance adjusting layer and the image carrier. The electric resistance adjusting layer is made from a resin composition containing a thermoplastic resin containing an ether group, an organic phosphonium salt and a fluorine-containing organic anion salt.

DETAILED DESCRIPTION OF THE PREFERRED EMBODIMENTS

Hereinafter, preferred embodiments of the present invention will be described in detail below with reference to the accompanying drawings.

Figure 1:
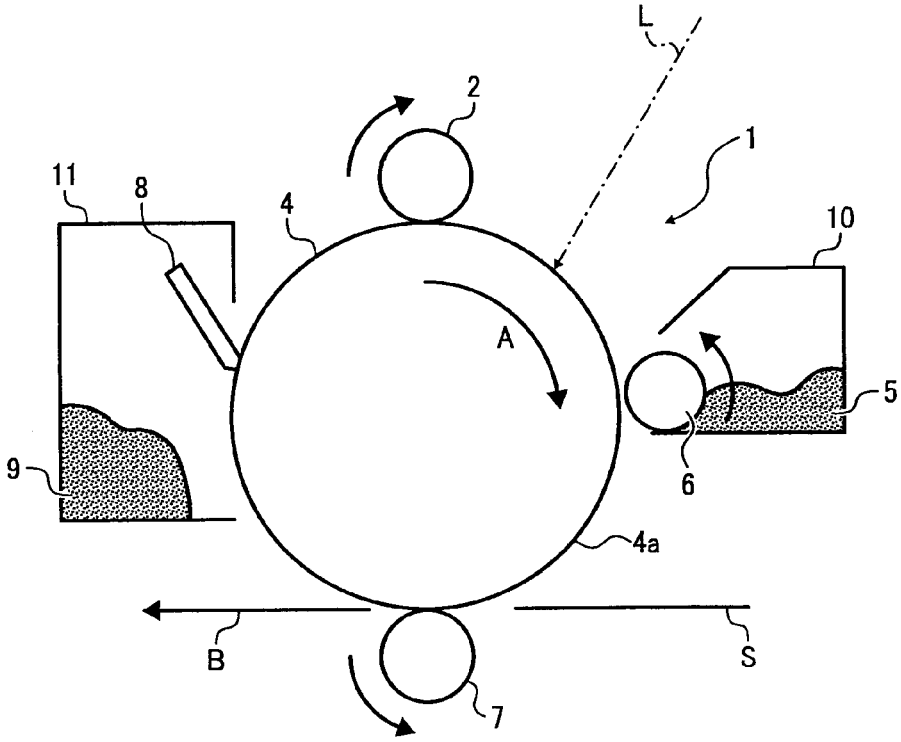
FIG. 1 shows a schematic configuration of a common image forming apparatus.
Figure 2:
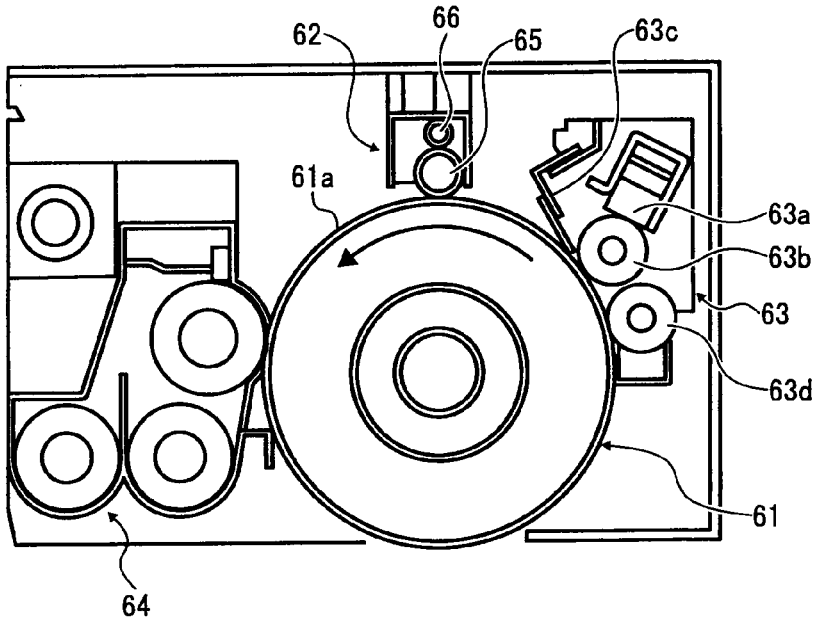
FIG. 2 shows a schematic configuration of a process cartridge.

FIG. 2 shows a schematic configuration of a process cartridge using a conductive member according to the present invention.

The process cartridge includes at least an image carrier 61, a charger unit 62, and a cleaning unit 63, or may further include a cleaning unit 64. This process cartridge is detachably attached to an image forming apparatus.

An image forming area of a surface 61*a* of the image carrier 61 is uniformly electrified by a charging member 65 disposed without contact with the image forming area. After an image (or an electrostatic latent image) is formed, it is visualized by the developing process to form a toner image, which in turn is transferred to a recording medium. A residual toner on the image carrier 61 without being transferred to the recording medium is withdrawn by an auxiliary cleaning member 63*d*.

Then, in order to prevent toner and a constituent material thereof from adhering to a surface 61*a* of the image carrier 61, a solid lubricant 63*a* is uniformly applied to the image carrier 61 by a coating member 63*b* to form a lubricant layer. Afterward, the residual toner after being withdrawn by the auxiliary cleaning member 63*d* is withdrawn by a cleaning member 63*c* and is carried to a waste toner withdrawal unit. The auxiliary cleaning member 63*d* can be in the shape of a roller or a brush. Fatty acid metal salt such as zinc stearate, polytetrafluoroethylene, or the like, for example, can be used as the solid lubricant 63*a*. However, the solid lubricant 63*a* is not limited to the above but may be made of other materials capable of reducing a coefficient of friction on the image carrier 61 and thus imparting non-adhesion to the image carrier 61. A blade made of silicone, urethane or other rubber, a fur brush made of polyester or other fibers, or the like, for example, can be used as the cleaning member 63*c*.

The charger unit 62 is provided with a cleaning member 66 for removing contamination from the charging member 65. Although the cleaning member 66 can be in the shape of a roller or a pad, the cleaning member 66 employed in the present invention is in the shape of a roller. The cleaning member 66 is fitted and rotatably and pivotally supported on a bearing disposed in a housing (not shown) of the charger unit 62.

The cleaning member 66 abuts the charging member 65 to clean the outer periphery thereof. If a foreign object, such as the toner, paper particles, or a broken piece of the member, adheres to the surface of the charging member 65, an electric field concentrates on an area where the foreign object exists, resulting in anomalous electrical discharge involving preferential discharge.

Conversely, if an electrically insulating foreign object adheres to the surface of the charging member 65 extensively, since discharge does not occur on the surface, an electrification spot is generated on the image carrier 61. Desirably, the charger unit 62 is therefore provided with the cleaning member 66 for cleaning the surface of the charging member 65. A brush made of the polyester or other fibers, or a porous material (e.g., sponge) such as a melamine resin, for example, can be used as the cleaning member 66. The cleaning member 66 is rotated with a differential linear velocity accompanying the rotation of the charging member 65. The cleaning member 66 may be intermittently rotated by engaging with and disengaging from the charging member 65.

The charger unit 62 is also provided with a power supply that applies a voltage to the charging member 65. Although a direct voltage alone can be used as the voltage, it is desirable that a combined voltage of a direct voltage and an alternating voltage be used. The reason is that if the charging member 65 is non-uniform in laminar configuration, an application of the direct voltage alone to the charging member 65 can possibly result in a non-uniformity in the surface potential of the image carrier 61. In contrast, an application of the superposed voltage to the charging member 65 leads to potential equalization on the surface of the charging member 65, which stabilizes discharge from the charging member 65, and the image carrier 61 can be uniformly charged. Desirably, the superposed voltage is set so that a peak-to-peak voltage of the alternating voltage is two or more times an initial electrification voltage of the image carrier 61.

Here, the electrification initial voltage refers to an absolute value of the voltage when the image carrier 61 starts to be charged by the application of the direct voltage alone to the charging member 65. The above setting leads to a reverse discharge from the image carrier 61 to the charging member 65, so that the image carrier 61 can be uniformly charged with higher stability by the effect of the reverse discharge making the electrification uniform. Desirably, the frequency of the alternating voltage is seven or more times a peripheral velocity (or process speed) of the image carrier 61. When the frequency is seven or more times the peripheral velocity, a Moiré image becomes unrecognizable or visually unrecognizable.

In the embodiment of the present invention, the auxiliary cleaning member 63*d* is configured of a brush roller; the lubricant is made of a block of zinc stearate; and the brush roller which is a coating member is pressurized by a pressurizing member such as a spring, to thereby sweep out a solid lubricant from a solid lubricant block and apply the solid lubricant to the image carrier. A urethane blade is used as the cleaning member 63*d* and is of a counter type. A sponge roller made of the melamine resin is used as the cleaning member 66 of the charging member 65. The cleaning member 66 is rotated accompanying the rotation of the charging member 65, which is capable of cleaning well superficial contamination of the charging member 65.

Figure 3:
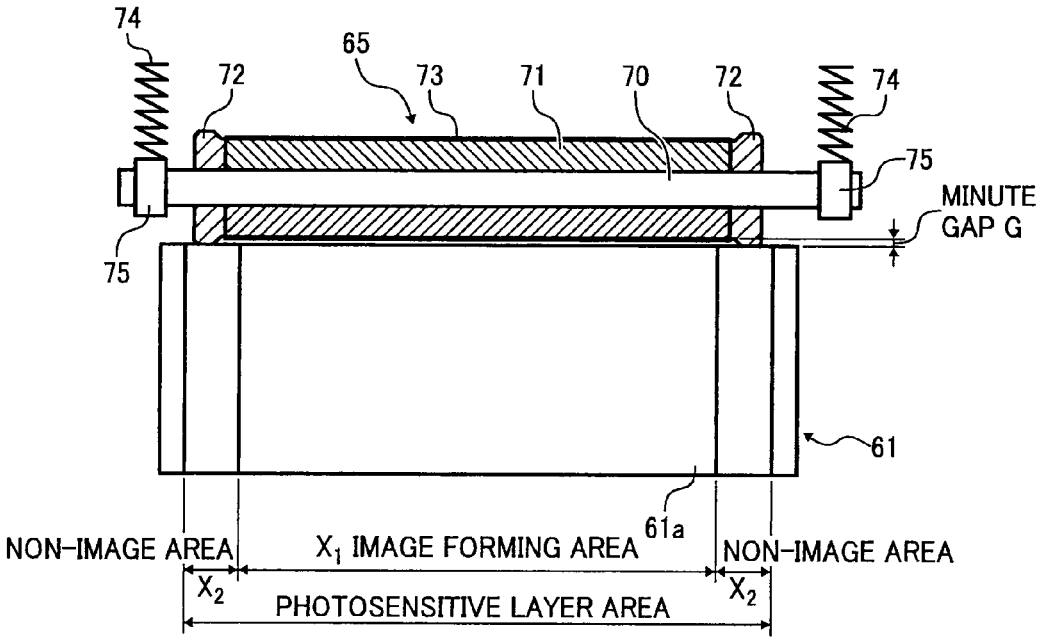
FIG. 3 illustrates a facing relationship in position between a conductive member and a photoreceptor drum according to the present invention.

As shown in FIG. 3, the charging member 65 has an electric resistance adjusting layer 71 and a pair of gap retaining members 72. The electric resistance adjusting layer 71 is formed on the periphery of an electrical conductive supporter 70. The pair of gap retaining members 72 is disposed at both ends of the electric resistance adjusting layer 71. Moreover, a surface layer 73 is formed on the electric resistance adjusting layer 71 so as to prevent the toner and toner additive from adhering to a surface of the electric resistance adjusting layer 71.

The charging member 65 is disposed to face the image carrier 61 with a minute gap G in between. To form the minute gap G between the charging member 65 and the image carrier 61, the pair of gap retaining members 72 abuts against a non-image area X2 of the charging member 65, whereby an image forming area X1 guarantees the existence of the minute gap G. Thus, even if there exist variations in a coating thickness of the photosensitive layer, the variations in the minute gap G can be reduced.

The charging member 65 is not particularly limited in shape and may be in the shape of a belt, a blade (or plate), or a semi-cylinder and be fixedly disposed. Alternatively, the charging member 65 may be of cylindrical shape and be rotatably supported at both ends on gears or bearings. When the charging member 65 is formed by a curved surface that gradually moves clear of a portion in closest proximity to the image carrier 61 upwardly and downwardly in the direction of movement relative to the image carrier 61, it is possible to charge the surface of the image carrier 61 more uniformly.

If a sharp portion is present on the surface of the charging member 65 facing the image carrier 61, a rise in a potential of the sharp portion starts preferential discharge, which makes it difficult for the image carrier 61 to become uniformly charged. Therefore, the charging member 65 is of a cylindrical shape and has a curved surface, whereby the image carrier 61 can become uniformly charged.

When discharge occurs on the charging member 65, the surface thereof is subjected to strong stress. If the discharge constantly occurs on the same surface, deterioration of the surface is accelerated. And more disadvantageously, the degraded surface can possibly be cut away. Therefore, when the charging member 65 is rotated so that the entire surface thereof can be used for discharge, the deterioration thereof can be prevented from an early stage and the charging member 65 can be used for a long duration.

The minute gap G between the charging member 65 and the image carrier 61 is set by the gap retaining members 72 so as to be equal to or less than 100 μm or particularly between 5 μm and 70 μm, whereby abnormal image formation during the operation of the charger unit 62 can be suppressed. Since 100 μm or more in the width of the minute gap G undesirably increases a distance covered by the electricity generated by the charging member 65 to reach the image carrier 61, consequently, there is generated an undesired rise in a discharge initiating voltage in accordance with Paschen's law. Furthermore, since a wider minute gap G further expands a discharge space between the charging member 65 and the image carrier 61, predetermined electrification of the image carrier 61 requires discharge to yield a large amount of discharge products. Consequently, the discharge products remain in the discharge space in a large amount even after the image formation and adhere to the image carrier 61, which causes an accelerated deterioration of the image carrier 61 with the lapse of time.

When the minute gap G is narrow, the distance covered by electricity generated by the charging member 65 to reach the image carrier 61 can be reduced. Thus, the image carrier 61 can become charged even if discharge energy is low. However, since the narrow gap G shrinks the space formed between the charging member 65 and the image carrier 61, ventilation of the air in the space is worsened. Therefore, since the discharge products formed in the discharge space remain therein in a large amount even after the image formation, the discharge products adhere to the image carrier 61, which causes an accelerated deterioration of the image carrier 61 with the lapse of time, as in the case with the wide minute gap G.

Therefore, it is desirable that the discharge energy and the generation of discharge products be reduced, and the space be such that air flows smoothly therein. Hence, it is desirable that the width of the minute gap G be set equal to or less than 100 μm or lie between 5 μm and 70 μm, which enables the prevention of an occurrence of streamer discharge and the reduction in the generation of discharge products. Therefore, the amount of discharge products accumulated on the image carrier 61 can be reduced, and thus a spotted image or a running image can be prevented.

Although the residual toner on the image carrier 61 after the developing process is removed by the cleaning unit 63 disposed facing the image carrier 61, the toner is difficult to be completely removed. Thus, traces of toner pass through the cleaning unit 63 and are conveyed to the charger unit 62. In such a situation, if the grain size of the toner is larger than the minute gap G, the above tone may possibly be fused onto the charging member 65 after being heated by being rubbed against the rotating image carrier 61 or the charging member 65. If the toner is fused onto the charging member 65, the fused portion of the toner will be brought close to the image carrier 61 correspondingly, which causes preferential discharge in a place where the toner is fused and the occurrence of anomalous discharge. Therefore, it is desirable that the width of the gap G be set larger than a maximum grain size of the toner for use in the image forming apparatus.

Bearing holes (not shown) are formed on a housing sidewall which composes a part of the charger unit 62. A pair of bearing members 75 of the charging member 65 is fitted to the bearing holes. The charging member 65 is pressed towards the image carrier 61 by springs 74.

This makes it possible to form the minute gap G with a certain width even if mechanical vibration or displacement of the image carrier 61 occurs. A press load to the image carrier 61 is set, for example, at 4 N to 25 N, or desirably at 6 N to 15 N. Even if the charging member 65 is fixedly located by the bearing members 75, the width of the minute gap G may vary and exceed a suitable range due to vibrations during rotation of the charging member 65, the displacement of the charging member 65, and asperities on the surface of the charging member 65. Consequently, the deterioration of the image carrier 61 is accelerated with the lapse of time.

As employed herein, the load refers to every load applied to the image carrier 61 via the gap retaining members 72. The load can be adjusted by forces exerted by the springs 74 disposed at both ends of the charging member 65, the weight of the charging member 65 and the cleaning member 66 on their own, or the like.

On the one hand, a light load makes it impossible to suppress variations during rotation of the charging member 65 or a rebound of the driven gears or the like by impact forces. On the other hand, a heavy load leads to an increase in the friction between the charging member 65 and the bearing members 75, which causes aggravated abrasion wear, resulting in acceleration of variations. Accordingly, the load lying between 4 N and 25 N or desirably between 6 N and 15 N enables the width of the gap G to fall within the suitable range, to reduce the generation of discharge products as well as the amount of discharge products accumulated on the image carrier 61. The service life of the image carrier 61 is thus lengthened. In addition, the occurrence of the abnormal spotted image or the running image becomes preventable.

The gap retaining members 72 are partially different in level from the electric resistance adjusting layer 71. An approach to forming the minute gap G between the electric resistance adjusting layer 71 and the gap retaining members 72 can be performed by simultaneously removing by machining, such as cutting or grinding, the electric resistance adjusting layer 71 and the gap retaining members 72. The simultaneous machining makes it possible to form the minute gap G with high precision.

When a height of a part of the gap retaining members 72 adjacent to the electric resistance adjusting layer 71 is set to be the same as or lower than that of the electric resistance adjusting layer 71, a non-contact width between the gap retaining members 72 and the image carrier 61 is guaranteed, which enables formation of the gap between the charging member 65 and the image carrier 61 with high precision.

This configuration can prevent the outer surface of the end of the gap retaining members 72 toward the electric resistance adjusting layer 71 from abutting the image carrier 61. The configuration can also prevent the occurrence of a leakage of current due to the adjacent electric resistance adjusting layer 71 coming into contact with the image carrier 61 with the above end in between.

When the ends of the gap retaining members 72 toward the electric resistance adjusting layer 71 are machined so as to be at a lower level, the ends can be used as a relief for a cutting edge or the like for the removal. Incidentally, the relief can be of any shape, provided that the shape is such that the outer surface of the ends of the gap retaining members 72 is not abutted with the image carrier 61.

When a masking is performed so as to coat a surface layer 73 at the boundary of the electric resistance adjusting layer 71 and the gap retaining members 72, it is difficult to control the masking due to the height difference therebetween. Therefore, the surface layer 73 can be formed either on the electric resistance adjusting layer 71 and the gap retaining members 72 with the same height or on the electric resistance adjusting layer 71 and the gap retaining members 72 with a lower height.

Since the gap retaining members 72 are required to maintain the minute gap G between the gap retaining members 72 and the image carrier 61 with a lasting stability in different environments, it is desirable that the gap retaining members 72 be made of a material having low moisture absorption and high abrasion resistance.

In addition, important properties for the gap retaining members 72 include a property of resisting adhesion of the toner and the toner additive, and a property of preventing the wearing away of the image carrier 61 in order for the gap retaining members 72 to slide whilst abutting the image carrier 61. The properties are appropriately selected according to various conditions.

To be specific, the gap retaining members 72 can be made from a general-purpose resin such as polyethylene (PE), polypropylene (PP), polyacetal (e.g., POM (polyoxymethylene)), polymethyl methacrylate (PMMA), polystyrene (PS), or a copolymer thereof (e.g., an AS (acrylonitrile-styrene) resin or an ABS (acrylonitrile-butadiene-styrene) resin), polycarbonate (PC), a urethane resin, a fluorocarbon resin (e.g., PTFE (polytetrafluoroethylene)), or the like.

In order to fix the gap retaining members 72, the gap retaining members 72 can be joined with an adhesive. Desirably, the gap retaining members 72 are made of an insulating material and have an intrinsic volume resistance value of $10^{13}$ Ωcm or more. The insulating material is required so as to eliminate the occurrence of a leakage of current between the gap retaining members 72 and the image carrier 61(e.g. photoreceptor). The gap retaining members 72 are formed by molding.

To obtain an ion conductive mechanism by ionic conduction, the electric resistance adjusting layer 71 is made from a thermoplastic resin (A) provided with an ether group in the molecules thereof and a resinous material containing an organic phosphonium salt as well as a fluorine-containing organic anion salt.

Ion conductivity is required in that when an electronic conductive material such as carbon black is used, since charges are discharged to the image carrier 61 via the carbon black, a minute discharge irregularity is prone to occur, which is a hindrance to the generation of a high-quality image.

In particular, this phenomenon becomes notable when a high voltage is applied. Examples of the ionic conductive material include salts of low molecular weight such as an alkali metallic salt and an ammonium salt, which are prone to bleed out because polarization easily occurs when current is applied. Therefore, as a high-molecular-form ionic conductive material, a resin containing a polyether group is employed. The salt is stabilized via the molecules' having the ether group with the oxygen atom, etc. being included in the ether bond. Thus, a low electric resistance value becomes obtainable.

By such a configuration, since the polymer type-ionic conductive material is uniformly dispersed and immobilized at the molecular level in a matrix polymer, the resistance value does not fluctuate as occurs in a compound having a conductive pigment dispersed poorly therein. Bleed out does not easily occur because the material is a high-molecular type.

However, since it is impossible to obtain a suitable resistance value only by using the thermoplastic resin (A) including the ether group in molecules thereof as a conductive material, salt is combined in use to make a low resistance value thereof achievable. Examples of a resin containing the polyether group include polyetheresteramide, polyether/polyolefin block polymer.

With respect to polyetheresteramide, polyether/ polyolefin block polymer, the resistance value, a water absorption rate and a hardness thereof are controlled by changing the compositional ratio of polyether to other constituents. In general, when the compositional ratio of polyether is raised, although a low resistance value can be obtained, the water absorption rate rises and the hardness is reduced.

When the water absorption rate is high, since the charging member 65 becomes more vulnerable to an environmental fluctuation, the minute gap G between the image carrier 61 and the charging member 65 becomes harder to maintain with high precision. In addition, when the hardness is reduced, it becomes more difficult for the charging member to be machined with high precision. Therefore, in order to obtain the desired characteristic properties, a blending of polyetheresteramide, polyether/polyolefin block polymer can be considered.

Although perchlorate is commonly used as a salt, because of a reaction thereof with water on an ionic dissociation, a strongly-alkaline substance is prone to be generated. Consequently, the resin is deteriorated and (solvent) cracks occur, which impair durability of the electrical conductive member. Therefore, instead of adding the perchlorate, an organic phosphonium salt is added. Even if the organic phosphonium salt reacts with water on ionic dissociation, since the strongly-alkaline substance is not generated, the cracks do not occur.

Although the occurrence of the cracks can be prevented by the addition of the organic phosphonium salt, since a voltage dependency of a resistance value of the electric resistance adjusting layer is small, the resistance value rises when a high voltage is applied to a commercially-produced apparatus. In general, due to the existence of moisture in the air, a resistance value of an ion conductive mechanism fluctuates greatly with the environmental variation and the resistance value rises under low-temperature-low-humidity conditions. When the organic phosphonium salt is used alone for the charging member 65, the resistance value thereof can not remain adequate because the resistance value thereof rises under circumstances of low temperature and low humidity. Consequently, there are generated an irregular discharge and a defective image.

Specifically, a white dot is generated when an analog halftone image is output. Therefore, a fluorine-containing organic anion salt is further added in addition to an organic phosphonium salt. Even if the voltage dependency of resistance is small, an irregular electrical discharge caused by the resistance rise is not generated under low-temperature-low-humidity conditions because the absolute value of resistance decreases along with the addition of the organic phosphonium salt and the fluorine-containing organic anion salt. Moreover, when a perchlorate is used to form the electric resistance adjusting layer 71, since on the one hand, a voltage dependency of the resistance value thereof is large and on the other hand, the resistance value rises greatly due to the polarization which occurs easily resulting from an energization, an irregular discharge on the electric resistance adjusting layer is prone to occur with the lapse of time. In contrast, with the addition of both the organic phosphonium salt and the fluorine-containing organic anion salt, since the voltage dependency of the resistance value of the electric resistance adjusting layer 71 is small, which causes the resistance value to rise slightly due to the energization, an irregular discharge on the electric resistance adjusting layer does not occur with the lapse of time.

Examples of the organic phosphonium salt include quarternary phosphonium salt such as ethyltriphenylphosphonium, tetrafluoroborate, tetraphenylphosphonium bromide, etc. As the fluorine-containing organic anion salt, a salt provided with an anion having a fluoro group and a sulfonyl group is desirably used. In this salt provided with the anion, since charges therein are delocalized due to a strong electron attractive effect of a fluoro group (—F) and a sulfonyl group (—SO2-), the anion exhibits a high dissociation degree in a stable polymer composition. Therefore, a high ion conductivity is achievable.

Since a decrease in resistance value can be easily achieved, alkali metal salts such as bis (fluoroalkylsulfonyl) imide alkali metal salt, tris (fluoroalkylsulfonyl) methide alkali metal salt, alkali metal salt of a fluoroalkylsulfonic acid and the like are preferable. Specifically, examples of the alkali metal salts include bis (trifluoromethane sulfonyl ) imide lithium ($Li(CF_3SO_2)_2N$), bis(trifluoromethane sulfonyl )imide kalium($K(CF_3SO_2)_2N$), bis(trifluoromethane sulfonyl)imide sodium($Na(CF_3SO_2)_2N$), tris (fluoroalkylsulfonyl) methide lithium($Li(CF_3SO_2)_3C$), tris (fluoroalkylsulfonyl) methide kalium ($K(CF_3SO_2)_3C$), tris (fluoroalkylsulfonyl) methide sodium($Na(CF_3SO_2)_3C$), lithium trifluoromethane sulfonate($Li(CF_3SO_3)$), potassium trifluoromethane sulfonate ($K(CF_3SO_3)$), sodium trifluoromethane sulfonate($Na(CF_3SO_3)$). In particular, lithium salts with a high electroconductivity like lithium trifluoromethane sulfonate, bis (trifluoromethane sulfonyl)imide lithium and tris (fluoroalkylsulfonyl) methide lithium are preferable.

Since the organic phosphonium salt and the fluorine-containing organic anion salt differ greatly in ionic radius on ionic dissociation when dispersed in a polymer composition, their respective conductive paths can not be obstructed. Therefore, a small amount of addition thereof can be adequately effective. The organic phosphonium salt and the fluorine-containing organic anion salt can be added to the high-molecular ionic conductive material and kneaded, whereby a prescribed ratio of addition can be obtained. In addition, a high-molecular ionic conductive material containing the fluorine-containing organic anion salt is obtainable, for example, the "Sankonol" series, available from SANKO CHEMICAL INDUSTRY, INCORPORATED.

The fluorine-containing organic anion salt is preferably compounded in an amount of 0.01 to 20 wt. % of the whole composition of the resin composition. On the one hand, when the amount compounded is less than 0.01 wt. %, an effect of decreasing the resistance value of the electric resistance adjusting layer 71 can not be obtained. On the other hand, when the amount compounded is more than 10 wt. %, because a decrease in hardness of the electric resistance adjusting layer 71 becomes notable, the machinability thereof becomes inadequate. Consequently, manufacture of the electric resistance adjusting layer 71 with high precision via cutting and grinding becomes unattainable. The amount of the organic phosphonium salt compounded needs considering likewise.

Desirably, the electric resistance adjusting layer 71 has an intrinsic volume resistance value within $10^6$ Ω cm to $10^9$ Ω cm. The intrinsic volume resistance value in excess of $10^9$ Ω cm renders an inadequacy of the capability of the charging member 101 to electrify the image carrier 61 or an inadequacy of the capability of transferring the toner image. An intrinsic volume resistance value of less than 106 Q cm leads to the occurrence of a leakage due to a voltage concentrating on the entire image carrier 61.

Machining like cutting and grinding is required to manufacture the charging member 65 in the present invention with high precision. Since polyetheresteramide, conventionally used as an elastomer, is soft with an unsatisfactory machinability, it is desirable that polyetheresteramide be blended with another thermoplastic resin with a higher hardness.

Namely, it is desired that a resin composition be formed by melting and kneading, after blending a thermoplastic resin containing the polyetheresteramide (the ether group) in a relatively large amount with a supplemented thermoplastic resin with a higher hardness, a mixture of the organic phosphonium salt, the fluorine-containing organic anion salt and a graft copolymer, etc., which will be illustrated hereinafter.

The machinability of a resin can be promoted when the hardness thereof becomes adequately high. A thermoplastic resin (B) with a high hardness is not particularly limited for use in the composition, and a general purpose resin such as polyethylene (PE), polypropylene (PP), polymethyl methacrylate (PMMA), polystyrene (PS) and a copolymer thereof (e.g., an AS resin or an ABS resin), as well as an engineering plastic, etc. such as polycarbonate or polyacetal, for example, are desirable because of being easily molded. With respect to a blending amount, the thermoplastic resin (A) containing ether group can be 30 to 80 wt. % and the thermoplastic resin with high hardness (B) can be 20 to 70 wt. % correspondingly, whereby a desired volume resistivity becomes obtainable.

When more than two kinds of resins are blended, an appropriate electric resistance value may not be obtained because of poor compatibility between resins. In such a situation, an addition of a compatibilizer such as a graft copolymer is desirable in that the compatibilizer enhances the compatibility.

A graft copolymer (C) has a polycarbonate resin in a main chain thereof and a acrylonitrile-styrene-glycidyl methacrylate terpolymer in a side chain thereof. Since the polycarbonate resin in the main chain has a chain of a polar group and a dioxy group in a molecular structure thereof, an intermolecular attractive force is remarkably strong. Therefore, the polycarbonate resin is excellent in mechanical strength, creep property and the like. In particular, the polycarbonate resin is outstandingly superior to other plastics in terms of impact strength. In addition, since the polycarbonate resin in the main chain has a relatively low water absorption, variations in volume thereof are not notable either. Based on all these properties explained heretofore, when the polycarbonate resin is used as the main chain of the graft copolymer, cracks do not easily occur either caused by mechanical stress or electrical stress while in use thereof, or caused by a variation in volume thereof induced by a lapse of time or the environment.

The acrylonitrile-styrene-glycidyl methacrylate terpolymer in the side chain is composed of an acrylonitrile component, a styrene component and a glycidyl methacrylate component being a reactive group. The glycidyl methacrylate component being the reactive group is tightly chemically bonded with a thermoplastic resin containing an ether group (A) by chemical coupling via an epoxy group reacting with an ester group or an amino group of the thermoplastic resin containing the ester group (A) by heat supplied when the above-mentioned components are melted and kneaded. Moreover, the acrylonitrile component and the styrene component have good compatibility with the thermoplastic resin having a high hardness (B). Therefore, functioning as a compatibilizer between the thermoplastic resin containing the ether group (A) and the thermoplastic resin having a high hardness (B) with an inherent low affinity therebetween, a graft copolymer of the graft copolymer (C) uniformizes and densifies a dispersion state of the two resins. Thus, cracks occurring at the welded part of the electric resistance adjusting layer, which are induced by the variation in the resistance value of the welded parts accompanied by the poor dispersion state of the thermoplastic resin containing the ether group (A) and the thermoplastic resin having a high hardness (B), by the mechanical stress or the electrical stress while in use thereof, or by a variation in volume thereof caused by a lapse of time or the environment, can be suppressed. As a result, a kneaded resin composition is formed being excellent in strength combined with the aforementioned properties of the main chain. The amount of the graft copolymer is set to be 1 to 15 wt. % of the total amount of the thermoplastic resin containing the ether group and the thermoplastic resin having the high hardness (B), whereby the compatibility between the thermoplastic resin containing the ether group (A) and the thermoplastic resin having the high hardness (B) can be enhanced and an excellent processing stability can be obtained.

The resin compound is not particularly limited in the manufacturing method thereof but can be easily manufactured by mixing materials and melting and kneading the materials by a biaxial kneader, a kneader, or the like. When the electrical conductive supporter 70 is coated with the a semi-conductive resin compound by extrusion molding, injection molding, or the like, the electric resistance adjusting layer 71 can be easily formed on the electrical conductive supporter 70.

When the electric resistance adjusting layer 71 alone is formed on the electrical conductive supporter 70 to form the electrical conductive member 65, the toner and the toner additive or the like can possibly adhere to the electric resistance adjusting layer 71 and thus cause deterioration in electrification performance. To prevent this problem from arising, a top surface layer can be formed on the electric resistance adjusting layer 71.

The surface layer 73 is formed in such a way that the resistance value thereof is larger than that of the electric resistance adjusting layer 71, whereby it is possible to avoid the voltage concentrating on a defective portion of the surface of the photoreceptor and to avoid the anomalous discharge (leakage). However, if the resistance value of the surface layer 73 is excessively high, the charging capability and the transferring capability are inadequate. A difference of the resistance value between the surface layer 73 and the electric resistance adjusting layer 71 will be illustrated hereinafter with reference to some examples and comparative examples.

EXAMPLE 1

An electrical conductive supporter 70 (a core shaft will be used hereinafter) made of stainless steel with an outer diameter of 8 mm was coated by injection molding with a resin composition (intrinsic volume resistance value $2\times10^8$ Ω cm) to form an electric resistance adjusting layer 71. The resin composition was obtained at a temperature of 220° C. by melting and kneading with an addition of 4.5 pts.wt. of polycarbonate-glycidyl methacrylate-styrene-acrylonitrile copolymer (Modiper CL440-G, manufactured by NOF Corporation), 3 pts.wt. of organic phosphonium salt (ETPP-FB, manufactured by NIPPON CHEMICAL INDUSTRIAL CO., LTD) and 1 pt.wt. of lithium trifluoromethane sulfonate (LiTFS, manufactured by MORITA CHEMICAL INDUSTRIES CO., LTD.) to 100 pts.wt. of a mixture consisting of 40 pts.wt. of ABS resin (Denka ABS GR-3000 manufactured by DENKI KAGAKU KOGYO), 42 pts.wt. of polyetheresteramide a (TPAE-10 manufactured by FUJI KASEI KOGYO CO.,LTD.) and 18 pts.wt. of polyetheresteramide b (TPAE-H151 manufactured by FUJI KASEI KOGYO CO.,LTD.).

Ring-shaped gap retaining members 72 made from a high-density polyethylene resin (e.g., Novatech HD HY540 manufactured by Japan Polyethylene Co., Ltd.) were force-fitted to both ends of the electric resistance adjusting layer 71 and joined with the core shaft 70 and the electric resistance adjusting layer 71 with an adhesive.

Then, a simultaneous finish was performed by the cutting work to make the outer diameter (the max diameter) of the gap retaining members 72 to be 12.12 mm and to make the outer diameter of the electric resistance adjusting layer 71 to be 12.00 mm, respectively. A surface layer 73 with a thickness of approximately 10 μm was formed on the electric resistance adjusting layer 71 with a mixture (surface resistance value: $2\times10^9$ Ω) made from acrylic silicone resin (3000VH-P, manufactured by KAWAKAMI PAINT Co., Ltd.), isocyanate series curative agent and carbon black (35 wt % with respect to all solid ingredients). The charging member 65 was formed as an electrical conductive member after a calcination process.

Example 2

A core shaft 70 made of stainless steel (with an outer diameter of 8 mm) was coated by injection molding with a resin composition (intrinsic volume resistance value $2\times10^8$ Ω cm) to form an electric resistance adjusting layer 71. The resin composition was obtained at a temperature of 220° C. by melting and kneading with an addition of 4.5 pts.wt. of polycarbonate-glycidyl methacrylate-styrene-acrylonitrile copolymer (Modiper CL440-G, manufactured by NOF Corporation), 3 pts.wt. of organic phosphonium salt (ETPP-FB, manufactured by NIPPON CHEMICAL INDUSTRIAL CO., LTD.) and 1 pt.wt. of bis(trifluoromethane sulfonyl)imide lithium (LiTFSI, manufactured by MORITA CHEMICAL INDUSTRIES CO., LTD.) to 100 pts.wt. of a mixture consisting of 40 pts.wt. of ABS resin (Denka ABS GR-3000 manufactured by DENKI KAGAKU KOGYO) and 60 pts.wt. of polyetheresteramide (TPAE-10HP, manufactured by FUJI KASEI KOGYO CO.,LTD.). Then, ring-shaped gap retaining members 72 made from a high-density polyethylene resin (e.g., Novatech HD HY540 manufactured by Japan Polychem Co., Ltd.) were force-fitted to both ends of the electric resistance adjusting layer 71 and joined with the core shaft 70 and the electric resistance adjusting layer 71 with an adhesive. After this, a simultaneous finish was performed by the cutting work to make the outer diameter (the max diameter) of the gap retaining members 72 to be 12.12 mm and to make the outer diameter of the electric resistance adjusting layer 71 to be 12.00 mm. A surface layer 73 with a thickness of approximately 10 μm was formed on the electric resistance adjusting layer 71 with a mixture (surface resistance value: $2\times10^9$ Ω) made from acrylic silicone resin (3000VH-P, manufactured by KAWAKAMI PAINT Co., Ltd.), isocyanate series curative agent and carbon black (35 wt % with respect to all solid ingredients). The charging member 65 was formed as an electrical conductive member after a calcination process.

Example 3

A core shaft 70 made of stainless steel (with an outer diameter of 8 mm) was coated by injection molding with a resin composition (intrinsic volume resistance value $3\times10^8$ Ω cm) to form an electric resistance adjusting layer 71. The resin composition was obtained at a temperature of 230° C. by melting and kneading with an addition of 4.5 pts.wt. of polycarbonate-glycidyl methacrylate-styrene-acrylonitrile copolymer (Modiper CL440-G, manufactured by NOF Corporation) and 5 pts.wt. of organic phosphonium salt (BTPP-Br, manufactured by NIPPON CHEMICAL INDUSTRIAL CO., LTD) to 100 pts.wt. of a mixture consisting of 40 pts.wt. of polycarbonate resin (Panlite L-1255LL manufactured by TEIJIN CHEMICALS LTD.) and 60 pts.wt. of polyetheresteramide containing lithium trifluoromethane sulfonate (Sankonol TBX-65, manufactured by SANKO CHEMICAL INDUSTRY, Co. Ltd.).

Then, ring-shaped gap retaining members 72 made from a high-density polyethylene resin (e.g., NOVATEC HD HY540 manufactured by Japan Polychem Co., Ltd.) were force-fitted to both ends of the electric resistance adjusting layer 71 and joined with the core shaft 70 and the electric resistance adjusting layer 71 with an adhesive. After this, a simultaneous finish was performed by the cutting work to make the outer diameter (the max diameter) of the gap retaining members 72 to be 12.12 mm and to make the outer diameter of the electric resistance adjusting layer 71 to be 12.00 mm. A surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). The charging member 65 was formed as an electrical conductive member after a calcination process.

Example 4

A core shaft 70 made of stainless steel(with an outer diameter of 8 mm) was coated by injection molding with a resin composition (intrinsic volume resistance value $4\times10^8$ Ω cm) to form an electric resistance adjusting layer 71. The resin composition was obtained at a temperature of 220° C. by melting and kneading with an addition of 9 pts.wt. of polycarbonate-glycidyl methacrylate-styrene-acrylonitrile copolymer (Modiper CL440-G, manufactured by NOF Corporation) and 3 pts.wt. of organic phosphonium salt (ETPP-I, manufactured by NIPPON CHEMICAL INDUSTRIAL CO., LTD) to 100 pts.wt. of a mixture consisting of 40 pts.wt. of ABS resin (Denka ABS GR-0500 manufactured by DENKI KAGAKU KOGYO) and 60 pts.wt. of polyethether/polyolefin block polymer containing lithium trifluoromethane sulfonate (Sankonol TBX-310, manufactured by SANKO CHEMICAL INDUSTRY, Co., Ltd.).

Then, ring-shaped gap retaining members 72 made of a high-density polyethylene resin (e.g., Novatech HD HY540 manufactured by Japan Polychem Co., Ltd.) were force-fitted to both ends of the electric resistance adjusting layer 71 and joined with the core shaft 70 and the electric resistance adjusting layer 71 with an adhesive. After this, a simultaneous finish was performed by the cutting work to make the outer diameter (the max diameter) of the gap retaining members 72 to be 12.12 mm and to make the outer diameter of the electric resistance adjusting layer 71 to be 12.00 mm. A surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). The charging member 65 was formed as an electrical conductive member after a calcination process.

Example 5

A core shaft 70 made of stainless steel (with an outer diameter of 8 mm) was coated by an injection molding with a resin composition (intrinsic volume resistance value $3\times10^8$ Ω cm) to form an electric resistance adjusting layer 71. The resin composition was obtained at a temperature of 220° C. by melting and kneading with an addition of 4.5 pts.wt. of polycarbonate-glycidyl methacrylate-styrene-acrylonitrile copolymer (Modiper CL440-G, manufactured by NOF Corporation), 6 pts.wt. of organic phosphonium salt (ETPP-FB, manufactured by NIPPON CHEMICAL INDUSTRIAL CO., LTD) and 1 pt.wt. of bis(pentafluoroethanesulfonyl)imide lithium (LiBETI, manufactured by KISHIDA CHEMICAL CO., LTD.) to 100 pts.wt. of a mixture consisting of 40 pts.wt. of HI-PS resin (H450, manufactured by TOYO STYRENE CO., LTD.) and 60 pts.wt. of polyetheresteramide (MV1041, manufactured by ARKEMA CO., LTD.).

Then, ring-shaped gap retaining members 72 made of a high-density polyethylene resin (e.g., NOVATEC HD HY540 manufactured by Japan Polyethylene Co., Ltd.) were force-fitted to both ends of the electric resistance adjusting layer 71 and joined with the core shaft 70 and the electric resistance adjusting layer 71 with an adhesive. After this, a simultaneous finish was performed by the cutting work to make the outer diameter (the max diameter) of the gap retaining members 72 to be 12.12 mm and to make the outer diameter of the electric resistance adjusting layer 71 to be 12.00 mm. A surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). The charging member 65 was formed as an electrical conductive member after a calcination process.

Comparative Example 1

A core shaft 70 made of stainless steel (with an outer diameter of 8 mm) was coated by an injection molding with a resin composition to form an electric resistance adjusting layer 71. The resin composition included 40 pts.wt. of ABS resin (Denka ABS GR-3000 manufactured by DENKI KAGAKU KOGYO) and 60 pts.wt. of polyetheresteramide (IRGASTAT P18, manufactured by CHIBA SPECIALITY CHEMICALS Co., LTD.) containing sodium perchlorate with no melting or kneading performed.

Then, ring-shaped gap retaining members 72 made of a polyacetal resin (e.g., POM SW01, manufactured by POLYPLASTICS Co., Ltd.) were force-fitted to both ends of the electric resistance adjusting layer 71 and joined with the core shaft 70 and the electric resistance adjusting layer 71 with an adhesive. After this, a simultaneous finish was performed by the cutting work to make the outer diameter (the max diameter) of the gap retaining members 72 to be 12.12 mm and to make the outer diameter of the electric resistance adjusting layer 71 to be 12.00 mm. A surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). The electrical conductive member 65 was formed after a calcination process.

Comparative Example 2

A core shaft 70 made of stainless steel (with an outer diameter of 8 mm) was coated by an extrusion molding with a resin composition to form an electric resistance adjusting layer 71. The resin composition included 40 pts.wt. of ABS resin (Denka ABS GR-0500 manufactured by DENKI KAGAKU KOGYO), 60 pts.wt. of polyetheresteramide (Pebax 5533, manufactured by Arkema Co., LTD.) and 3 pts.wt. of organic phosphonium salt (ETPP-I, manufactured by NIPPON CHEMICAL INDUSTRIAL CO., LTD.) with no melting or kneading performed.

Then, ring-shaped gap retaining members 72 made of a polyamide resin (NOVAMID 1010C2, manufactured by MITSUBISHI ENGINEERING-PLASTICS Corp.) were force-fitted to both ends of the electric resistance adjusting layer 71 and joined with the a core shaft 70 and the electric resistance adjusting layer 71 with an adhesive. After this, a simultaneous finish was performed by the cutting work to make the outer diameter (the max diameter) of the gap retaining members 72 to be 12.12 mm and to make the outer diameter of the electric resistance adjusting layer 71 to be 12.00 mm. A surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). The electrical conductive member 65 was formed after a calcination process.

Compartive Example 3

A core shaft 70 made of stainless steel (with an outer diameter of 8 mm) was coated by an injection molding with a resin composition to form an electric resistance adjusting layer 71. The resin composition included 40 pts.wt. of ABS resin (Techno ABS 170, manufactured by TECHNOPOLY- MER Co., LTD.) and 60 pts.wt. of block type thermoplastic elastomer (Pelestat NC6321, manufactured by SANYO CHEMICAL INDUSTRIES, LTD.). Then, a finish was performed by the cutting work to make the outer diameter of the electric resistance adjusting layer 71 to be 12.00 mm. After this, a surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). Then tape-shaped members (DITAC PF025-H manufactured by DAINIPPON INK AND CHEMICALS, INCORPORATED) with a thickness of 50 μm were pasted on a periphery of both ends of the electric resistance adjusting layer 71 with a one-component epoxy compounded resin adhesive (2202, manufactured by THREEBOND Co., LTD.), whereby the electrical conductive member 65 was obtained.

Comparative Example 4

A core shaft 70 made of stainless steel (with an outer diameter of 8 mm) was coated by extrusion molding with a resin composition to form an electric resistance adjusting layer 71. The resin composition was obtained by blending 2 pts.wt. of lithium perchlorate into 100 pts.wt. of a mixture consisting of 40 pts.wt. of ABS resin (Techno ABS 110, manufactured by TECHNOPOLYMER Co., LTD.) and 60 pts.wt. of block type thermoplastic elastomer (Pelestat 300, manufactured by SANYO CHEMICAL INDUSTRIES, LTD.).

Then, a finish was performed by the cutting work to make the outer diameter of the electric resistance adjusting layer 71 to be 12.00 mm. After this, ring-shaped gap retaining members 72 made of a polyacetal resin (e.g., POM YF10, manufactured by POLYPLASTICS Co., Ltd.) were force-fitted to both ends of the electric resistance adjusting layer 71 and joined with the core shaft 70 and the electric resistance adjusting layer 71 with an adhesive. A surface layer 73 with a thickness of approximately 10 μm was formed on the electric resistance adjusting layer 71 with a mixture (surface resistance value: $2\times10^9$ Ω) made of acrylic silicone resin (3000VH-P, manufactured by KAWAKAMI PAINT Co., Ltd.), isocyanate series curative agent and carbon black (35 wt % with respect to all solid ingredients). The electrical conductive member 65 was formed after a calcination process.

Component constitutions corresponding to Examples 1 to 5 and Comparative Examples 1 to 4 are illustrated in Table 1.

TABLE 1

| | | Resistance adjusting layer | | | | Surface |
|---|---|---|---|---|---|---|
| | | Thermoplastic resin containing ether group(A) | Thermoplastic resin (B) | Compatibilizer (C) | Conductive agent (salt, carbon black) | layer Resin/ conductive agent |
| Example 1 | material | TPAE-10/ TPAE-H151 blend | ABS GR-3000 | Modiper-CL440G | ETPP-FB LiTFS | Acrylic silicone/ Carbon black |
| | blended amount | 42/18 pts. wt., 60 pts. wt. in total | 40 pts. wt. | 4.5 pts. wt. relative to 100 pts. wt. of mixture A and B | 3 pts. wt., 1 pts. wt. relative to 100 pts. wt. of mixture A and B | 65 pts. wt./ 35 pts. wt. |
| Example 2 | material | TPAE-10HP | ABS GR-3000 | Modiper-CL440G | ETPP-FB LiTFSI | Acrylic silicone/ Carbon black |
| | blended amount | 60 | 40 | 4.5 pts. wt. relative to 100 pts. wt. of mixture A and B | 3 pts. wt., 1 pts. wt. | 65 pts. wt./ 35 pts. wt. |
| Example 3 | material | TBX-65 (containing LiTFS) | PC L-1225LL | Modiper-CL440G | BTBB-Br | Acrylic silicone/ Carbon black |
| | blended amount | 60 | 40 | 4.5 pts. wt. relative to 100 pts. wt. of mixture A and B | 5 pts. wt. | 65 pts. wt./ 35 pts. wt. |
| Example 4 | material | TBX-310(containing LiTFS) | ABS GR-0500 | Modiper-CL440G | ETPP-I | Acrylic silicone/ Carbon black |
| | blended amount | 60 | 40 | 9 pts. wt. | 3 pts. wt. | 65 pts. wt./ 35 pts. wt. |
| Example 5 | material | MV 1041 | HI-PS H450 | Modiper-CL440G | ETPP-FB LiBETI | Acrylic silicone/ |

TABLE 1-continued

| | | Resistance adjusting layer | | | | Surface |
|---|---|---|---|---|---|---|
| | | Thermoplastic resin containing ether group(A) | Thermoplastic resin (B) | Compatibilizer (C) | Conductive agent (salt, carbon black) | layer Resin/ conductive agent |
| | | | | | | Carbon black |
| | blended amount | 60 | 40 | 4.5 pts. wt. | 6 pts. wt., 1 pts. wt. | 65 pts. wt./ 35 pts. wt. |
| Comparative Example 1 | material | IRGASTAT P18 (containing Sodium Perchlorate) | ABS GR-3000 | None | None | Acrylic Silicone/Carbon black |
| | blended amount | 60 | 40 | — | — | 65 pts. wt./ 35 pts. wt. |
| Comparative Example 2 | material | Pebax 5533 | ABS GR-0500 | None | ETPP-I | Acrylic Silicone/Carbon black |
| | blended amount | 60 | 40 | — | 3 pts. wt. | 65 pts. wt./ 35 pts. wt. |
| Comparative Example 3 | material | Pelestat NC 6321 | ABS Techno 170 | None | None | Acrylic Silicone/Carbon black |
| | blended amount | 60 | 40 | — | — | 65 pts. wt./ 35 pts. wt. |
| Comparative Example 4 | material | Pelestat 300 | ABS Techno 110 | None | Lithium perchlorate | Acrylic Silicone/Carbon black |
| | blended amount | 60 | 40 | — | 2 | 65 pts. wt./ 35 pts. wt. |

After the conductive member 65 obtained from the above-mentioned Examples 1 to 5 and Comparative Examples 1 to 4 was placed for one day in a low-temperature-low-humidity environment (a temperature at 10° C., a relative humidity at 15%), an electric resistance of the conductive material 65 was measured (initial value). Then, in an evaluation environment of a temperature at 23° C. and a relative humidity at 50%, by using an acceleration testing device converted from an image forming apparatus, an idle running test was performed for 24 hours (equivalent to 30,000 copies) on the conductive member (charger roller) without feeding paper. The charger roller after applying current was then placed in the low-temperature-low-humidity environment (the temperature at 10° C., the relative humidity at 15%) for 24 hours. The measurement of the electric resistance value of the charger roller (the measurement after applying current continuously) was performed thereafter, the same as that performed before applying current. Then, an image evaluation was performed in the low-temperature-low-humidity environment (the temperature at 10° C., the relative humidity at 15%) by using the image forming apparatus while applying a voltage at DC=−700V, AC $V_{PP}$=2.7 kV (with a frequency of 3 kHz) to the charger roller.

Figure 4:
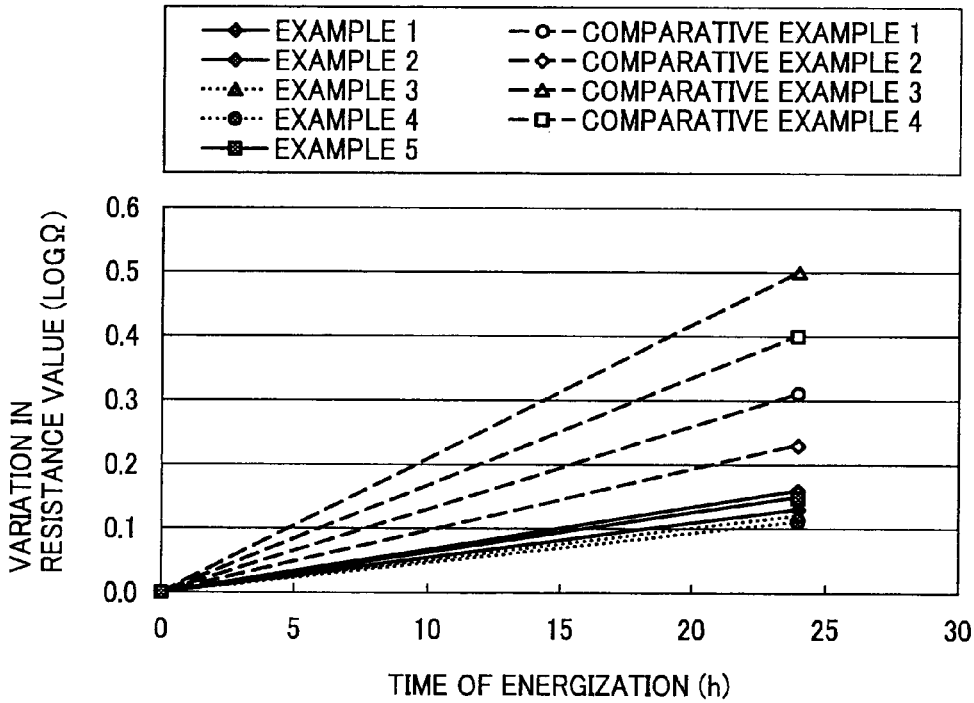
FIG. 4 is a graph illustrating variations in a resistance value of the conductive member corresponding to examples of the present invention and comparative examples.

The results are illustrated in Table 2 and FIG. 4.

TABLE 2

| | 100 V Resistance value (initial) LOG Ω | 100 V Resistance value (after energization) LOG Ω | Variation in resistance value LOG Ω | Defective image induced by irregular discharge | Evaluation |
|---|---|---|---|---|---|
| Example 1 | 5.40 | 5.56 | 0.16 | No | OK |
| Example 2 | 5.60 | 5.73 | 0.13 | No | OK |
| Example 3 | 6.00 | 6.12 | 0.12 | No | OK |
| Example 4 | 5.90 | 6.01 | 0.11 | No | OK |

TABLE 2-continued

| | 100 V Resistance value (initial) LOG Ω | 100 V Resistance value (after energization) LOG Ω | Variation in resistance value LOG Ω | Defective image induced by irregular discharge | Evaluation |
|---|---|---|---|---|---|
| Example 5 | 5.76 | 5.91 | 0.15 | No | OK |
| Comparative Example 1 | 6.00 | 6.31 | 0.31 | Yes | NG |
| Comparative Example 2 | 6.10 | 6.33 | 0.23 | Yes | NG |
| Comparative Example 3 | 6.20 | 6.70 | 0.50 | Image output unavailable | NG |
| Comparative Example 4 | 6.15 | 6.55 | 0.40 | Yes | NG |

FIG. 4 illustrates variations in the resistance value of the conductive member 65 with the lapse of time corresponding to the time of energization. In FIG. 4, with the horizontal axis representing energizing time and the vertical axis representing the variations in the electric resistance value, the variations in the electric resistance value after 24 hours are illustrated. It is obvious from FIG. 4 that the resistance values of the conductive member (charger roller) 65, obtained from Examples 1 to 5, hardly fluctuated before and after the energization while those obtained from Comparative Examples 1 to 4, fluctuated drastically before and after the energization. The variations in the electric resistance value are presented in terms of logarithmic value.

In addition, as illustrated in Table 2, the initial resistance values of the conductive member (charger roller) 65, obtained from Examples 1 to 5, are slightly lower than those obtained from Comparative Examples 1 to 4. The measurement of the resistance value herein was performed by bringing terminals of a tester in contact with both ends of the electric resistance adjusting layer 71 in the longitudinal direction of 100V, whereby the electric resistance values were obtained in terms of logarithmic value. For instance, 5.40 represents $5.40\times10^8$ Ω. All of the resistance values are of the same order.

Meanwhile, it is obvious that variations in the resistance values of the conductive member (charger roller) 65, obtained from Examples 1 to 5, are about half of those obtained from Comparative Examples 1 to 4 in average.

Moreover, images of good quality, made by image evaluation, were obtained by an image forming apparatus with the use of the conductive member (charger roller) 65 from Examples 1 to 5.

In contrast, since the resistance values of the conductive member (charger roller) 65 in Comparative Examples 1 to 4 increased notably after a 24-hour continuous energization, a defective image was generated due to an irregular discharge. Among Comparative Examples 1 to 4, in particular, in Comparative Example 3 output of image even became unavailable because of a high resistance value of the conductive member (charger roller) 65.

Although the preferred embodiments of the present invention have been described, it should be noted that the present invention is not limited to these embodiments, and various changes and modifications can be made to the embodiments.

What is claimed is:

1. A conductive member comprising:

a conductive supporter;

an electric resistance adjusting layer formed on the conductive supporter; and gap retaining members which are of a different material from that of the electric resistance adjusting layer and are disposed respectively at both ends of the electric resistance adjusting layer for contacting an image carrier so as to maintain a predetermined gap between the electric resistance adjusting layer and the image carrier, wherein the electric resistance adjusting layer is made from a resin composition containing a thermoplastic resin containing an ether group;

an organic phosphonium salt; and a fluorine-containing organic anion salt.

2. The conductive member according to claim 1, wherein a compounding ratio of the organic phosphonium salt and the fluorine-containing organic anion salt is 0.01~10 wt. % with respect to a total amount of the resin composition.

3. The conductive member according to claim 2, wherein the fluorine-containing organic anion salt is one of the lithium trifluoromethane sulfonate, the bis (trifluoromethane sulfonyl) imide lithium or the tris (fluoroalkylsulfonyl) methide lithium.

4. The conductive member according to claim 1, wherein the fluorine-containing organic anion salt is one of a lithium trifluoromethane sulfonate, a bis (trifluoromethane sulfonyl) imide lithium or a tris (fluoroalkylsulfonyl) methide lithium.

5. The conductive member according to claim 1, wherein the thermoplastic resin containing the ether group is made from a compound having at least a polyether ester amide and a polyether-polyolefin block polymer.

6. The conductive member according to claim 1, wherein the resin composition is prepared by melting and kneading the thermoplastic resin containing the ether group;

a thermoplastic resin having a higher hardness than the thermoplastic resin containing the ether group; and a graft copolymer which has an affinity for both the thermoplastic resin containing the ether group and the thermoplastic resin having the higher hardness than the thermoplastic resin containing the ether group.

7. The conductive member according to claim 6, wherein the graft copolymer includes a polycarbonate resin in a main chain and an acrylonitrile-styrene-glycidyl methacrylate terpolymer in a side chain.

8. The conductive member according to claim 1, wherein the electric resistance adjusting layer includes a surface layer which prevents a toner from attaching to an outer surface of the electric resistance adjusting layer.

9. The conductive member according to claim 8, wherein the surface layer is made from one of an acrylic resin, an acrylic silicone resin, a polyurethane resin, a fluoroethylene resin, a polyester resin, a polyamide resin or a polyvinyl butyral resin.

10. The conductive member according to claim 8, wherein the surface layer is made from a resin composition with a conductive agent dispersed therein.

11. The conductive member according to claim 1, wherein the electric resistance adjusting layer is cylinder-shaped with a core shaft thereof being the conductive supporter.

12. The conductive member according to claim 1, to which an AC voltage superposed on a DC voltage is applied when in use.

13. The conductive member according to claim 1, wherein the conductive member is a charging member.

14. A process cartridge comprising the charging member according to claim 13.

15. An image forming apparatus comprising the process cartridge according to claim 14.

* * * * *